US007354323B1

(12) United States Patent
Mayers

(10) Patent No.: US 7,354,323 B1
(45) Date of Patent: Apr. 8, 2008

(54) MOTOR MOUNT FOR WATERCRAFT

(76) Inventor: Tom W. Mayers, P.O. Box 64, 7250 Gulf of Mexico Dr., Longboat Key, FL (US) 34228

( * ) Notice: Subject to any disclaimer, the term of this patent is extended or adjusted under 35 U.S.C. 154(b) by 339 days.

(21) Appl. No.: 11/120,279

(22) Filed: May 3, 2005

(51) Int. Cl.
*B63H 5/20* (2006.01)
*B63B 17/00* (2006.01)

(52) U.S. Cl. ..... 440/53; 114/362

(58) Field of Classification Search ..... 440/53–58; 248/640–643; 114/362
See application file for complete search history.

(56) References Cited

U.S. PATENT DOCUMENTS 2,928,630 A * 3/1960 Wisman ..... 248/641
2,928,631 A * 3/1960 Hartman ..... 248/641
2,950,699 A * 8/1960 Ogden et al. ..... 114/61.22
3,242,899 A * 3/1966 Hanson ..... 440/62
4,545,559 A * 10/1985 Gilbreath ..... 248/642
5,322,030 A * 6/1994 Brehmer ..... 114/343

* cited by examiner

*Primary Examiner*—Lars A Olson
*Assistant Examiner*—Daniel V Venne
(74) *Attorney, Agent, or Firm*—William E. Mouzavires

(57) ABSTRACT

A motor mount for a watercraft having a frame of tubular construction fixed to the stern of the watercraft to space the motor from the stern. The frame includes a pair of vertical legs receiving a yoke slidable along the legs. The motor is fixed to the yoke to be raised or lowered by a cable connected to the yoke. The frame includes a horizontal mounting member which also serves to provide a step for boarding or deboarding the watercraft.

10 Claims, 3 Drawing Sheets

MOTOR MOUNT FOR WATERCRAFT

OBJECTS OF THE PRESENT INVENTION

The present invention relates to a method and apparatus for mounting a motor to a motorboat, sailboat or other watercraft for propelling the watercraft.

An object of the present invention is to provide novel method and apparatus for mounting a motor to watercraft such as a sailboat or motorboat.

A further object of the present invention is to provide a novel motor mount for watercraft which makes it easy to raise or lower the motor into a desired position with respect to the water or the associated watercraft. Included herein is such a motor mount which allows the motor to be moved into desired position through minimum, manual effort.

Another object of the present invention is to provide a motor mount that will achieve the above objects and yet may also serve as a platform for boarding or deboarding the associated watercraft.

A further object of the present invention is to provide such a motor mount that may be economically manufactured with a rugged construction and easily applied to new or conventional motorboats, sailboats or other watercraft.

SUMMARY OF PREFERRED EMBODIMENT OF THE PRESENT INVENTION

In its preferred form, the present invention includes a yoke mounted to and for movement along any suitable frame or body, the latter being attached to the stern wall of the watercraft. The motor is fixed to the yoke and the latter is movable along the body to raise or lower the motor relative to the watercraft or waterline. A cable and block and tackle may be attached to the yoke for manually moving the yoke up or down. If desired the mounting body may be configured to also serve as a platform or step for boarding or deboarding the watercraft.

DRAWINGS

Other objects of the present invention will become apparent from the following more detailed description taken in conjunction with the attached drawings in which.

DETAILED DESCRIPTION

Figure 1:
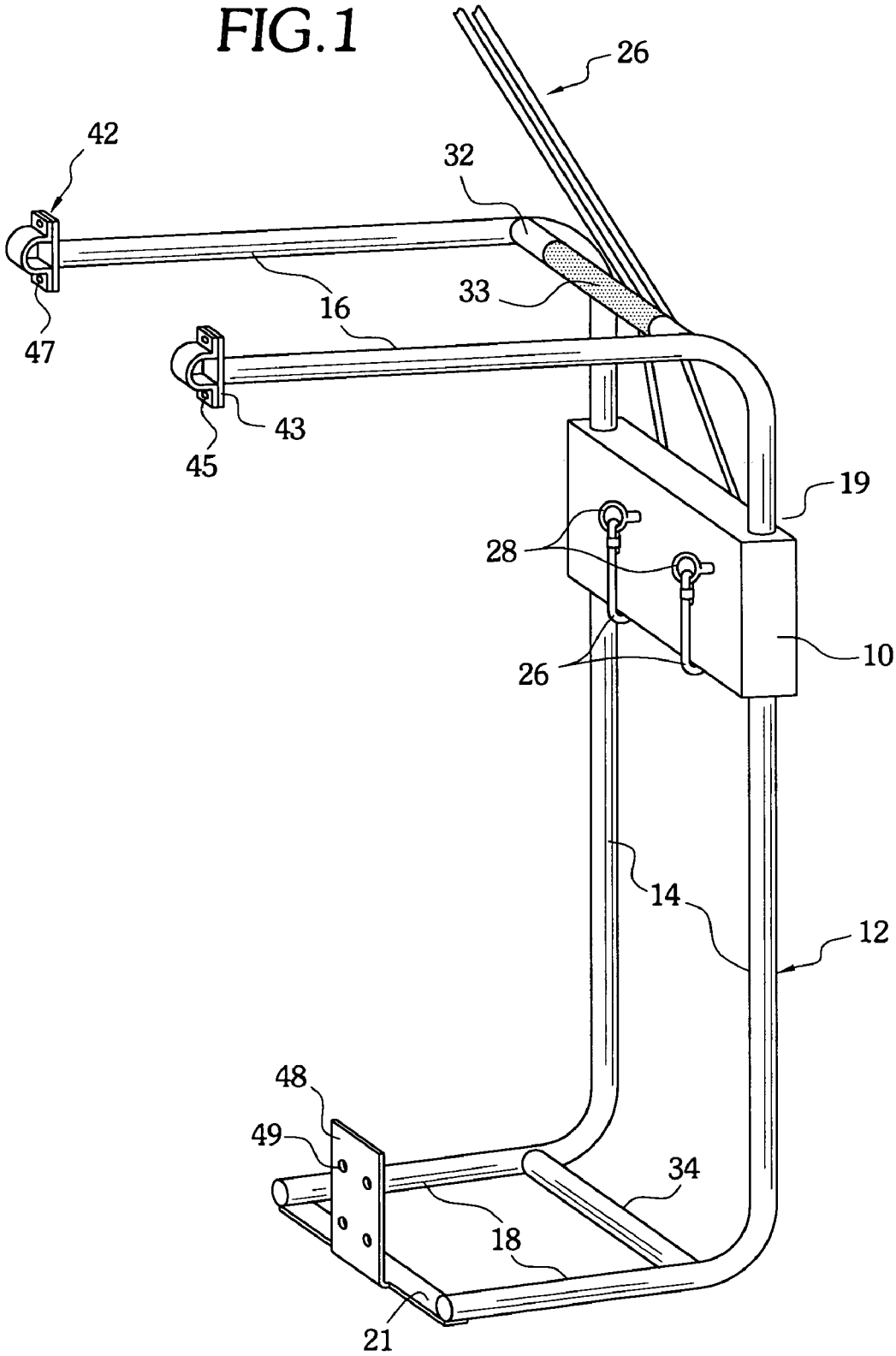
FIG. 1 is a perspective view of a motor mount constituting a preferred embodiment of the present invention.

Referring now to the drawings in detail there is shown for illustrative purposes only, a motor mount constituting a preferred embodiment of the present invention including as shown in FIG. 1, a yoke or slide 10 mounted for vertical movement along a support body shown as an open frame generally designated 12. In the preferred embodiment frame 12 is rigid and made from rods or tubes including vertical legs 14 laterally spaced from each other and longitudinally extending between pairs of upper and lower mounting members 16, 18 which extend in the forward direction generally at right angles from legs 14. The ends of mounting members 18 are interconnected by a cross-piece 21.

In the specific form shown yoke 10 has a generally rectangular body including a pair of vertically extending cylindrical passages 19 respectively receiving the legs 14 of the frame so that yoke 10 is slidable along the legs. Preferably a pair of bearing sleeves of suitable material such as ultra high molecular-weight plastic are provided in passages 19. The motor 24 (FIG. 2) is fixed to the yoke 10 in any suitable manner such as clamping or bolting so that the motor 24 is movable with the yoke 10 vertically along the legs 14. The motor 24 may be moved by a rope or cable line 26 fixed to yoke 10 in any suitable manner such as shown by eyes 28 fixed to the yoke. Cable 26 is provided with a block and tackle 30 shown in FIG. 2. The cable 26 may be secured in a jam cleat or other device attached to the aft stay 50 of the sailboat.

In the specific embodiment shown, frame 12 further includes upper and lower reinforcing cross-pieces 32 and 34 extending between and fixed to legs 14. The upper cross-piece 32 is preferably provided with a layer of low friction material such as nylon or mylar 33 or other, ultra high molecular material since the cable 26 is engaged and guided by cross-piece 32 in the specific embodiment shown.

Figure 2:
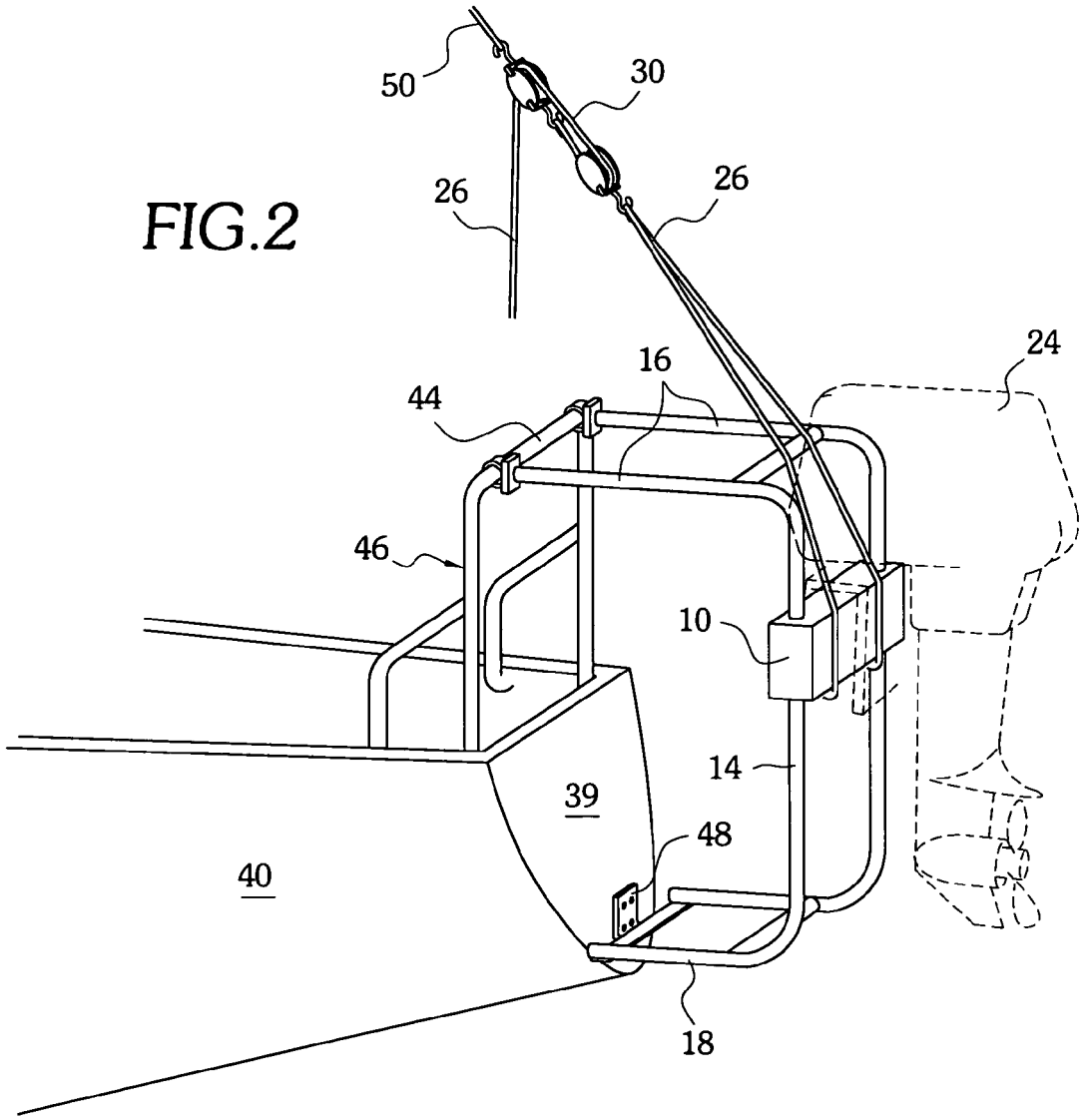
FIG. 2 is an elevational view of the motor mount with motor attached to the stern of a sailboat.

Referring to FIG. 2 the frame 12 may be attached to the stern 39 of a sailboat generally designated 40 by clamps 42 on the ends of mounting members 16. Clamps 42 grip about the cross-piece 44 of a railing 46 fixed on the stern of the sailboat as shown in FIG. 2. In the shown embodiment, clamps 42 include an abutment plate 43 welded to mounting member 16 and a "C" plate bolted to abutment plate 43 through apertures shown at 47 in FIG. 1. Of course any other suitable clamp or fastening means may be employed. In addition the lower mounting members 18 are provided with a mounting plate 48 which is bolted to the wall of the stern 39 through apertures 49 and bolts (not shown). In the shown embodiment plate 48 is welded to cross-piece 21, however in another embodiment it may be hinged to the cross-piece.

Figure 3:
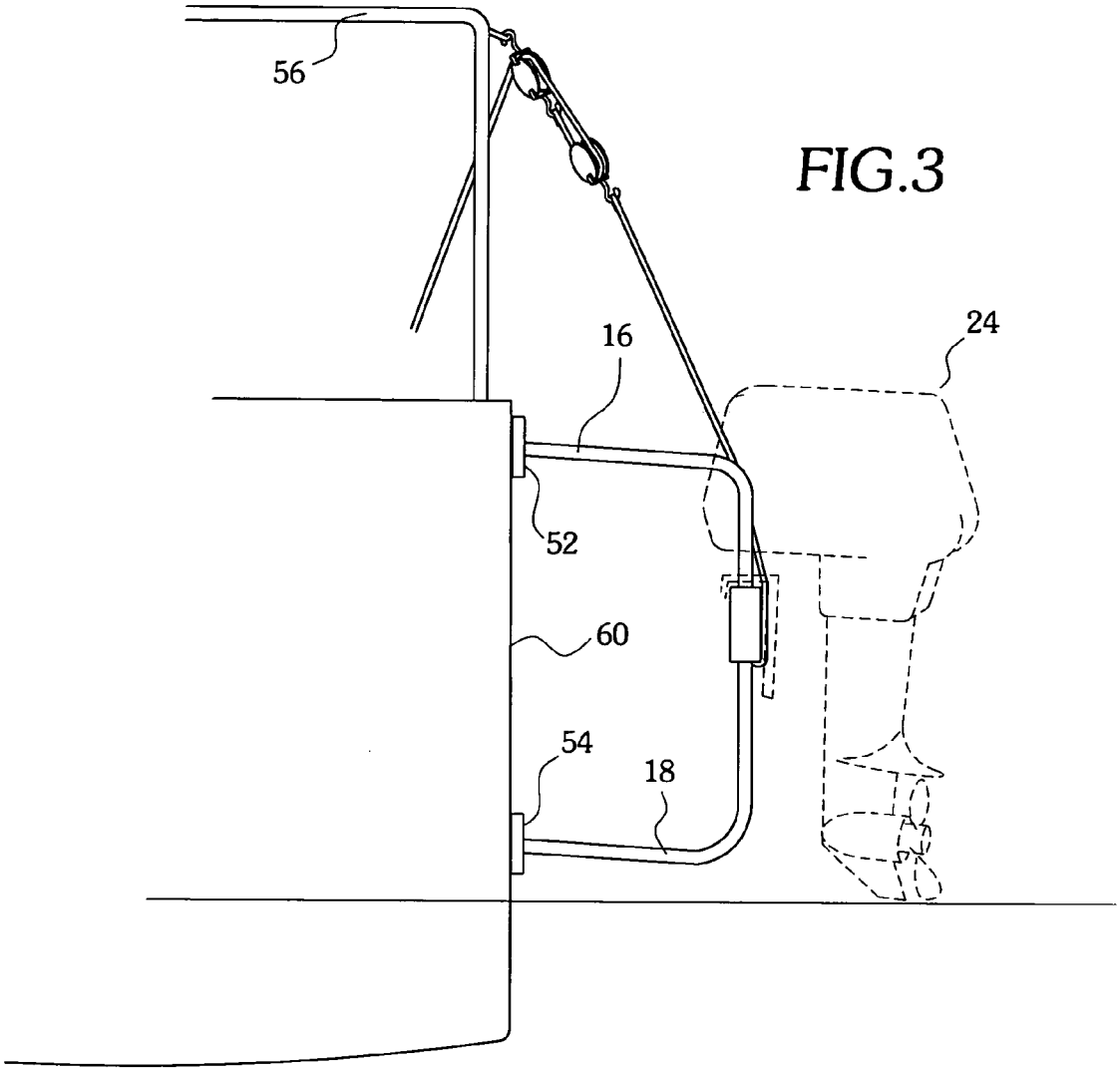
FIG. 3 is a view similar to FIG. 2 but with the motor mount attached to a motorboat.

The motor mount of the present invention may also be used on a motorboat as shown in FIG. 3. In this embodiment, the frame is secured to the stern 60 of the boat by plates 52 fixed to the ends of upper mounting members 16 and fixed to the stern. In addition the lower mounting members 18 of the frame are provided with mounting plates 54 which are fixed to the stern wall as in the embodiment of FIG. 2. The cable 16 is secured to a jam cleat or other suitable holding device attached to the railing 56 at the stern as shown in FIG. 3.

The frame may be a welded tubular construction with material such as stainless steel or other rust-resistant material. The same material may be used for the surface of the yoke.

In use, the motor 24 may be lifted out of the water merely by pulling the cable 26 which is easily done through the mechanical advantage provided by the block and tackle pulley system 30. This will raise the yoke 10 and the motor along the legs 14 of the frame. Once in the desired position, the cable is secured in the jam cleat or other holding device. To lower the motor, the cable 26 is released from the jam cleat and the yoke and motor allowed to descend under gravity while under control of the operator who holds on to the cable to gradually allow it to reel out as the motor descends. The cable is re-secured to the jam cleat to hold the motor in the desired lower position.

The motor mount may also be used to provide a platform or step to permit access to the boat by stepping on the lower cross-piece 34 or mounting member 18 to board or deboard from the boat. It will also be seen that the present invention provides a motor mount that is economical to manufacture from readily available and durable materials for easy use with new or conventional boats.

Although preferred forms of the present invention have been shown and described above, it will be understood that various adaptations of the present invention will become obvious to those skilled in the art but without departing from the scope of the present invention as defined in the appended claims. For example, although a preferred welded tubular frame construction has been shown and described as the body of the motor mount, other shapes and construction may be employed without departing from the invention. Also a hydraulic or other motor actuating system may be provided to raise or lower the yoke.

What is claimed is:

1. A motor mount for watercraft comprising in combination, a mounting body adapted to be mounted to the stern of the watercraft, a yoke for holding a motor for propelling the watercraft, means mounting the yoke to said body for vertical movement on said body, and means connected to said yoke for actuating the yoke to raise or lower a motor fixed to the yoke, said means mounting the yoke being vertically elongated to extend above the stern and enable a motor to be raised above the stern of the watercraft, said body further including upper and lower mounting members projecting forwardly at an angle from said legs and having fastening means on the ends thereof for fixing the body with respect to the stern of the watercraft, said mounting members being sufficiently elongated to space the motor from the stern to allow the motor to be swung from side to side while also providing a step at the lower mounting member of sufficient dimension to receive the feet of a user for boarding or deboarding the watercraft.

2. The motor mount defined in claim 1 wherein said upper mounting members are located above the stern and said fastening means are engageable with a railing located above the stern of the watercraft for fixing the body to the railing.

3. The motor mount defined in claim 1 wherein said fastening means are clamps having sockets for receiving a railing above the stern of a watercraft.

4. The motor mount defined in claim 1 wherein said means for actuating said yoke includes a line connected to said yoke to be manually raised or lowered to raise or lower a motor attached to said yoke.

5. The motor mount defined in claim 4 wherein said fastening means are clamps having sockets for receiving a railing above the stern of a watercraft.

6. The motor mount defined in claim 5 wherein said body further includes a crosspiece interconnecting said means mounting the yoke and having an outer surface of low friction material to facilitate movement of said line over said crosspiece.

7. In combination with a watercraft having a stern and a railing above the stern, a motor mount for mounting a motor to the stern including a frame including a pair of laterally spaced legs extending vertically, a yoke for fixing a motor thereto, said yoke being mounted to the legs to be vertically movable along the legs for raising and lowering the motor, said legs being sufficiently elongated in the vertical direction to extend above the stern and enable the motor to be raised above the stern, upper and lower mounting members projecting from the legs at an angle to the legs and being respectively fixed to said railing and stern with the upper mounting members located above the stern, said mounting members being sufficiently elongated to substantially space the motor from the stern and provide a step at the lower mounting member for receiving the feet of a user for boarding or deboarding the watercraft, and a line attached to the frame for raising and lowering the yoke.

8. The combination defined in claim 7 wherein said upper mounting members have clamps fixing the frame to said railing, said clamps having sockets receiving the railing.

9. The combination defined in claim 8 wherein the watercraft has a pulley system and the line is connected to the pulley system for manually raising and lowering the yoke including a motor attached to the yoke.

10. The combination defined in claim 9 wherein said frame includes a crosspiece interconnecting said legs and having a low friction surface over which said line is slideable.

* * * * *